US005587722A

United States Patent [19]

Suzuki et al.

[11] Patent Number: 5,587,722

[45] Date of Patent: Dec. 24, 1996

[54] ACTIVE MATRIX DISPLAY DEVICE

[75] Inventors: Yoshio Suzuki; Yoshiharu Nakajima, both of Kanagawa, Japan

[73] Assignee: Sony Corporation, Tokyo, Japan

[21] Appl. No.: 77,041

[22] Filed: Jun. 16, 1993

[30] Foreign Application Priority Data

Jun. 18, 1992 [JP] Japan ..... 4-184408

[51] Int. Cl.[6] ..... G09G 3/36

[52] U.S. Cl. ..... 345/94; 345/92; 345/208

[58] Field of Search ..... 345/87, 92, 94, 345/110, 204, 205, 206, 208, 95, 210; 359/55, 59

[56] References Cited

U.S. PATENT DOCUMENTS

| | | | |
|---|---|---|---|
| 3,862,360 | 1/1975 | Dill et al. | 359/59 |
| 4,532,506 | 7/1985 | Kitajima et al. | 345/92 |
| 5,200,741 | 4/1993 | Usui | 345/210 |

FOREIGN PATENT DOCUMENTS

| | | | |
|---|---|---|---|
| 0196889 | 10/1986 | European Pat. Off. . | |
| 0487137A1 | 5/1992 | European Pat. Off. . | |
| 63-259516 | 10/1988 | Japan | 345/94 |
| 02157814 | 6/1990 | Japan | 345/95 |
| 04097122 | 3/1992 | Japan | 345/95 |
| 5035215 | 2/1993 | Japan | 345/92 |

*Primary Examiner*—Richard Hjerpe
*Assistant Examiner*—Lun-Yi Lao
*Attorney, Agent, or Firm*—Hill, Steadman & Simpson

[57] ABSTRACT

An active matrix liquid crystal display device comprises pixels composed of a liquid crystal arranged in a matrix and transistors for driving the pixels. In a selected period of time, gate pulses GP are applied to a gate electrode of each transistor for writing video signals in each pixel. Subsequently, in a non-selected period of time, the applying of the gate pulses is stopped for holding the written video signals. In a transition from the selected period of time to the non-selected period of time, the voltage shift of the video signals can be suppressed by shaping of a fall of the gate pulses step-wisely. In place of the above method, the voltage shift of the video signals can be also suppressed by shaping a fall of the gate pulses through dropping the gate pulses after lowering the voltage level of the gate pulses in a specified value once directly before the transition from the selected period of time to the non-selected period of time.

2 Claims, 5 Drawing Sheets

4 D TYPE FLIP-FLOP
3 SHIFT REGISTER
VST
VVDD
VCK1
VCK2
1 VERTICAL SCANNING CIRCUIT
2 HORIZONTAL DRIVER CIRCUIT
Ym
Vsig
GP
LP
D
Tr
G
X1
X2
X3
X4
5
6
7
8
9
10
11
12
13

ACTIVE MATRIX DISPLAY DEVICE

BACKGROUND OF THE INVENTION

1. Field of the Invention

The present invention relates to a an active matrix display device, and particularly to an active matrix liquid crystal display device including means for applying gate pulses to transistors connected to pixels composed of a liquid crystal.

2. Description of the Related Art

The general construction of a prior art active matrix liquid crystal display device will be briefly described with reference to FIG. 5. FIG. 5 is a typical equivalent circuit diagram showing an area including one pixel. Each pixel is provided at an intersection between a gate line X and a signal line Y. The pixel composed of a liquid crystal is equivalently indicated at a liquid crystal capacitance $C_{LC}$. In general, the liquid crystal capacitance $C_{LC}$ is connected in parallel to an auxiliary capacitor $C_S$. In the liquid crystal capacitance $C_{LC}$, one end is connected to a driver transistor Tr and the other end is connected to an opposed electrode, from which a specified reference voltage Vcom is applied. The transistor Tr comprises an MISFET type film transistor. A drain electrode D of the transistor Tr is connected to a signal line Y to receive video signals Vsig. A source electrode S is connected to one end of the liquid crystal capacitance $C_{LC}$, that is, the pixel electrode. A gate electrode G is connected to the gate line X, and is applied with gate pulses having a specified gate voltage Vgate. A coupling capacitance $C_{GS}$ is formed between the liquid crystal capacitance $C_{LC}$ and the gate electrode G. The coupling capacitance $C_{GS}$ is a combination of a floating capacitance component between the pixel electrode and the gate line X, and a parasitic capacitance component between the source area and a gate area within the transistor Tr. In the coupling capacitance $C_{GS}$, the latter parasitic capacitance component is predominant, and which tends to be varied depending on each transistor Tr.

Next, the problem to be solved by the present invention will be briefly described with reference to FIG. 6. When a gate pulse with a voltage Vgate is applied to a gate electrode G in a selected period of time, the transistor Tr becomes in the on-state. At this time, video signals Vsig supplied from the signal line Y is written on the pixel made of a liquid crystal, that is, the so-called sampling is carried out. Then, in a non-selected period of time, the applying of the gate pulses is stopped, and the written video signals are held in the liquid crystal capacitance $C_{LC}$. At a transition from the selected period of time to the non-selected period of time, the rectangular gate pulse is shaped into a rapid fall from a high level to a low level. At this time, the charge stored in the liquid crystal capacitance $C_{LC}$ by means of the coupling through the above-described coupling capacitance $C_{GS}$ is instantaneously discharged, thus causing a voltage shift $\Delta V$ in the video signals Vsig written in the pixel. Since the coupling capacitance $C_{GS}$ is varied depending on each pixel, the voltage shift $\Delta V$ is varied. This results in a disadvantage of generating the so-called rough-feeling on the display screen, resulting in the significant deterioration of the display quality.

In each pixel composed of a liquid crystal, video signals are written in a selected period of time, and the written video signals are held in the subsequent non-selected period of time, to thus constitute one field. The transmissivity of the pixel in one field is dependent on the effective voltage applied to the liquid crystal in the one field. The driver transistor is required to secure the on-current necessary for completing the writing within the selected period of time. Also, in order to obtain the effective voltage enough to lighten the pixel during the one field, the leak current in the non-selected period of time, that is, the holding period of time is reduced as small as possible. The effective voltage is largely affected in the non-selected period of time which is very longer than the selected period of time. Accordingly, the above-described voltage shift $\Delta V$ generated in the on-state after charging of the liquid crystal capacitance $C_{LC}$ is greatly affected by the effective voltage applied to the liquid crystal, thereby damaging the display quality.

Conventionally, for suppressing the absolute amount and the variation of the voltage shift $\Delta V$, there has been proposed a technique wherein an auxiliary capacitor $C_S$ connected in parallel to the liquid crystal capacitance $C_{LC}$ is formed so as to be larger. Namely, the technique is intended to previously store the charge enough to supplement the charge amount discharged through the coupling capacitance $C_{GS}$ in the auxiliary capacitor $C_S$. However, since the auxiliary capacitor $C_s$ is formed in the pixel area, there arises such a disadvantage that, if the dimension thereof is set to be larger, the opening ratio of the pixel is sacrificed, which makes it impossible to obtain the sufficient display contrast.

SUMMARY OF THE INVENTION

Accordingly, an object of the present invention is to suppress the voltage shift of the video signals caused by the coupling capacitance between the gate electrode and the source electrode without sacrificing the aperture ratio of the pixel. The above object is accomplished by improving the applying of the gate pulses.

In accordance with the present invention, there is provided an active matrix display device comprising a plurality of display elements arranged in a matrix, each of which comprises a transistor for driving a pixel, means for providing gate pulses sequentially to the gate electrode during a selected period of time to apply video signals to each pixel, means for stopping the gate applied during a non-selected period of time to hold the applied video signals, and means for suppressing a voltage shift of the applied video signals.

In a preferred embodiment, the suppressing means comprises means for shaping a fall of the gate pulses smoothly.

In an another preferred embodiment, the suppressing means comprises means for shaping a fall of the gate pulses into a step-wise shape.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, the preferred embodiments of the present invention will be described in detail with reference to the accompanying drawings.

Figure 1A:
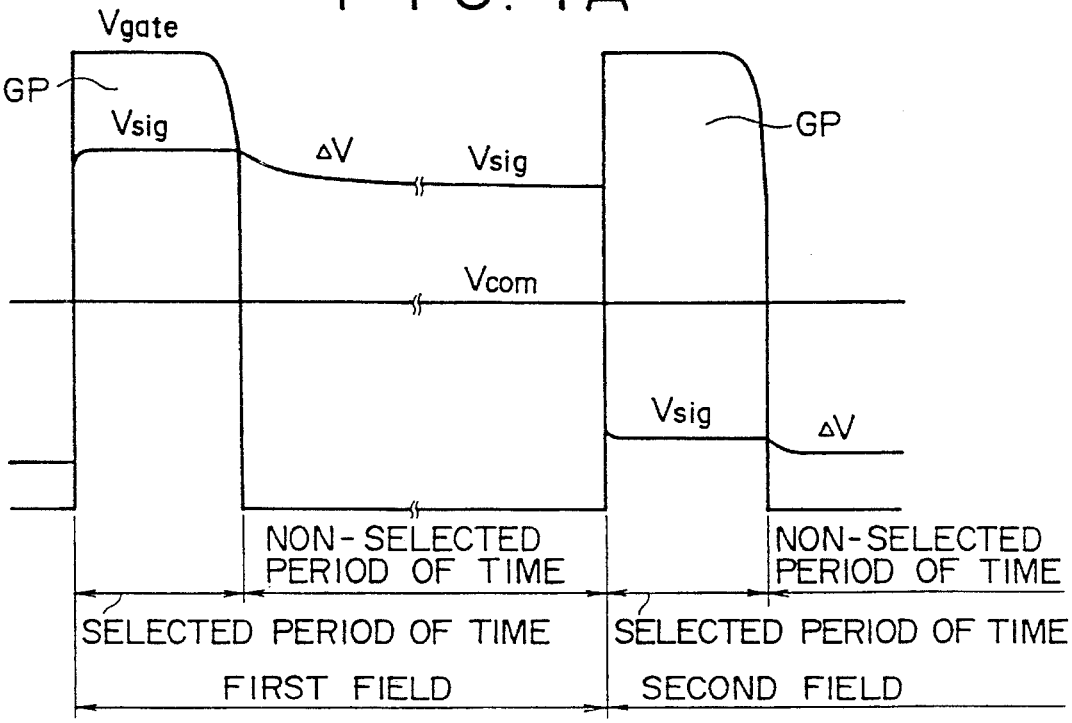
FIG. 1A–1B are typical views showing a methods for driving an active matrix liquid crystal display device according to the present invention.

Hereinafter, the above means will be described with reference to FIGS. 1A and 1B. Two means are provided for achieving the same object. A first means as shown in FIG. 1A is constructed as follows: Namely, there is provided an active matrix liquid crystal display device comprising pixels composed of liquid crystal arranged in a matrix and transistors for driving the pixels, wherein gate pulses GP are applied to a gate electrode of each transistor during a selected period of time for writing video signals Vsig to each pixel, and the applying of the gate pulses GP is stopped in a non-selected period of time for holding the written video signals Vsig, thereby performing the video display. In the above device, a voltage shift ΔV of the written video signals Vsig is suppressed by shaping a fall of the gate pulses GP smoothly in a transition from the selected period of time to the non-selected period of time.

In the active matrix liquid crystal display device, for prolonging the service life of the liquid crystal, the A.C. drive is carried out for inverting the polarity of the video signals Vsig for each field. In FIG. 1, in a first field, the video signals Vsig with the positive polarity are written in the pixel for a specified reference voltage Vcom applied to the opposed electrode. On the contrary, in a second field, the video signals Vsig with the negative polarity are written. At a certain gate time, in the first field, the gate pulses GP with a specified gate voltage Vgate are applied to the gate electrode of the transistor in the selected period of time. The fall of the gate pulses GP is so as to be smooth. Accordingly, as compared with the conventional manner in which the fall of the gate pulses GP is shaped to be rapid, the voltage shift ΔV is made smaller, which makes it possible to hold it at the specified level in the non-selected period of time. In the second field, similarly, the fall of the gate pulses GP are shaped as to be smooth, so that it is possible to suppress the voltage shift ΔV. In addition, differently from the fall of the gate pulses GP, even if the rise of the gate pulses GP is shaped to be rapid, the video quality is not affected by the rapid rise of the gate pulses GP.

Figure 1B:
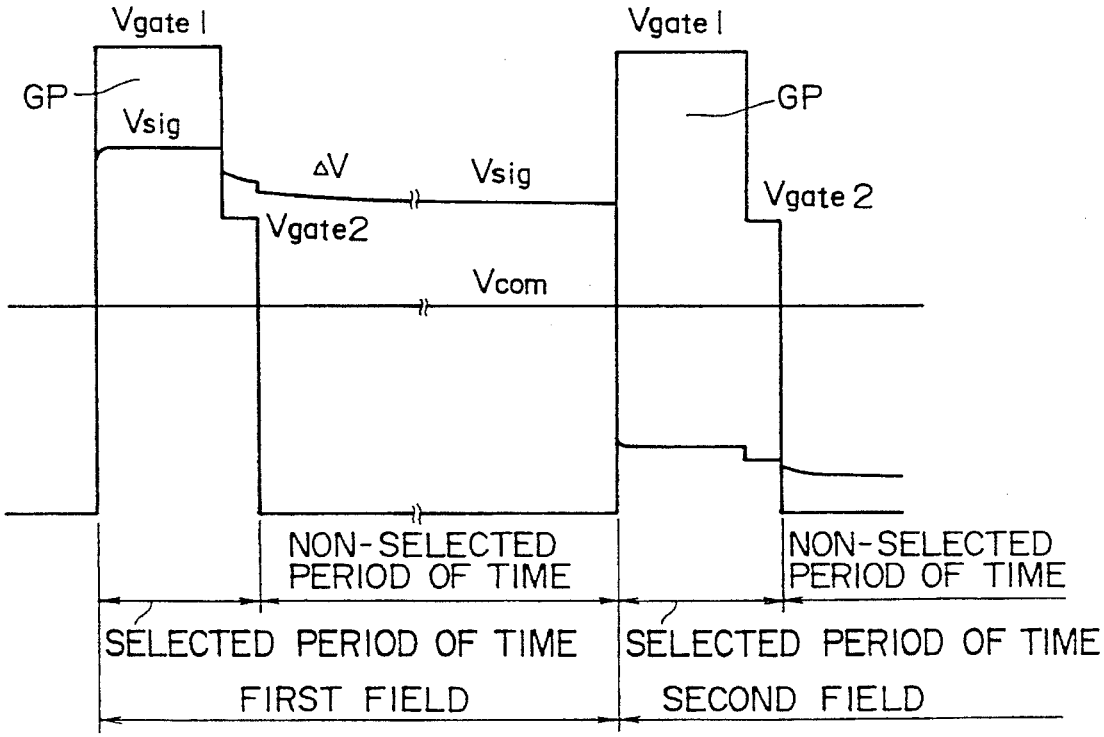

In the means as shown in FIG. 1B, the voltage shift ΔV of the written video signals Vsig is suppressed by shaping a fall of the gate pulses through dropping the gate pulses after lowering the voltage level Vgate1 of the gate pulses GP to be the value of Vgate2 directly before a transition from the selected period of time to the non-selected period of time. In addition, the timing for lowering the voltage level of the gate pulses GP is set so as not to exert an effect on the writting action to the pixel in the selected period of time. Namely, at the time when the writing is completed, the gate voltage Vgate1 is lowered so as to be the value of Vgate2. The second means is particularly effective to hold the writing and holding of the video signals with the negative polarity. For example, in the second field, there is generated a large potential difference between the gate voltage Vgate1 and the video signals Vsig. By dropping the gate pulses after lowering the gate voltage Vgate1 to the value of Vgate2 once, it is possible to make the potential difference small between the gate line and the source electrode at the transition from the selected period of time to the non-selected period of time. This makes it possible to effectively suppress the voltage shift ΔV.

Hereinafter, the function of the present invention will be described.

Figure 5:
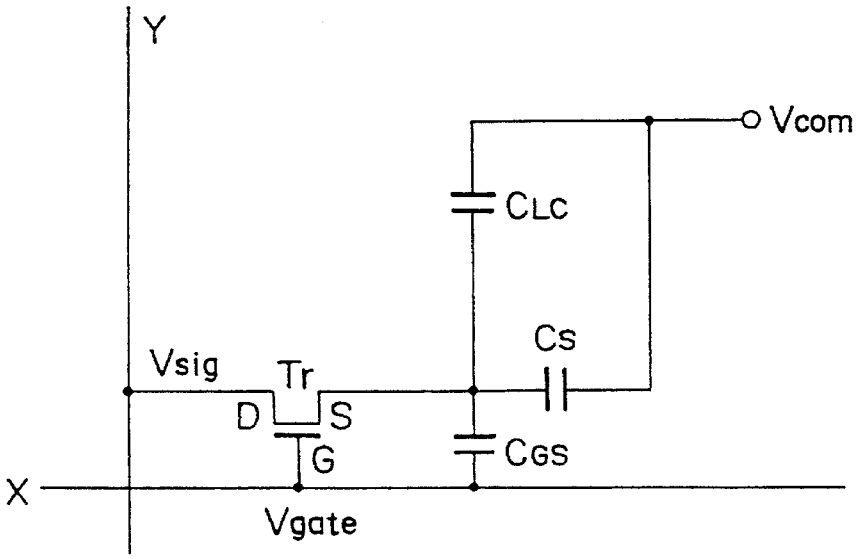
FIG. 5 (PRIOR ART)
FIG. 5 is an equivalent circuit diagram showing a prior art active matrix liquid crystal display device.
Figure 6:
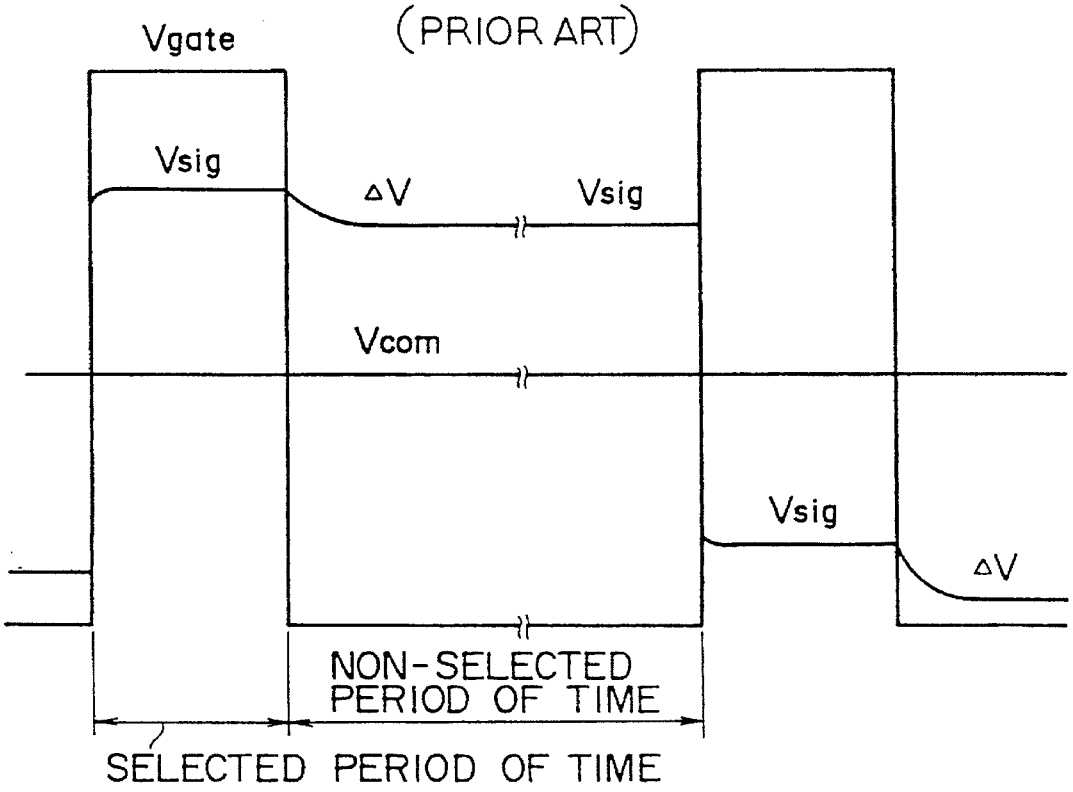
FIG. 6 (PRIOR ART)
FIG. 6 is a typical view for explaining the problem of the prior art method of driving an active matrix liquid crystal display device.

As described above with reference to FIG. 5, the voltage shift ΔV of the video signals is made larger in proportion to the coupling capacitor $C_{GS}$ between the gate electrode and the source electrode. On the contrary, the voltage shift ΔV is made smaller as the liquid crystal capacitance $C_{LC}$ and the auxiliary capacitor $C_S$ are made larger. Further, it is made larger in proportion to the potential difference $V_{GS}$ between the gate electrode and the source electrode. The potential difference $V_{GS}$ corresponds to the potential difference between the gate voltage Vgate and the written video signals Vsig at the transition from the selected period of time to the non-selected period of time. The above-described relationships are expressed by the following equation:

$$\Delta V = C_{GS}/(C_{LC}+C_{GS}+C_S)\times V_{GS}$$

Incidentally, the impedance of the coupling capacitance $C_{GS}$ is dependent on the frequency, and tends to easily pass higher frequency components. Consequently, in the first means as shown in FIG. 1A, the high frequency components are eliminated by shaping the fall of the gate pulses smoothly, thus suppressing the voltage shift caused by the coupling through the coupling capacitance.

As is apparent from the above equation, it is possible to suppress the voltage shift ΔV by reducing the potential difference $V_{GS}$ between the gate electrode and the source electrode. Accordingly, in the second means as shown in FIG. 1B, the voltage shift ΔV is suppressed by shaping a fall of the gate pulses by dropping the gate pulses directly after lowering the gate voltage once for reducing the $V_{GS}$.

Figure 2:
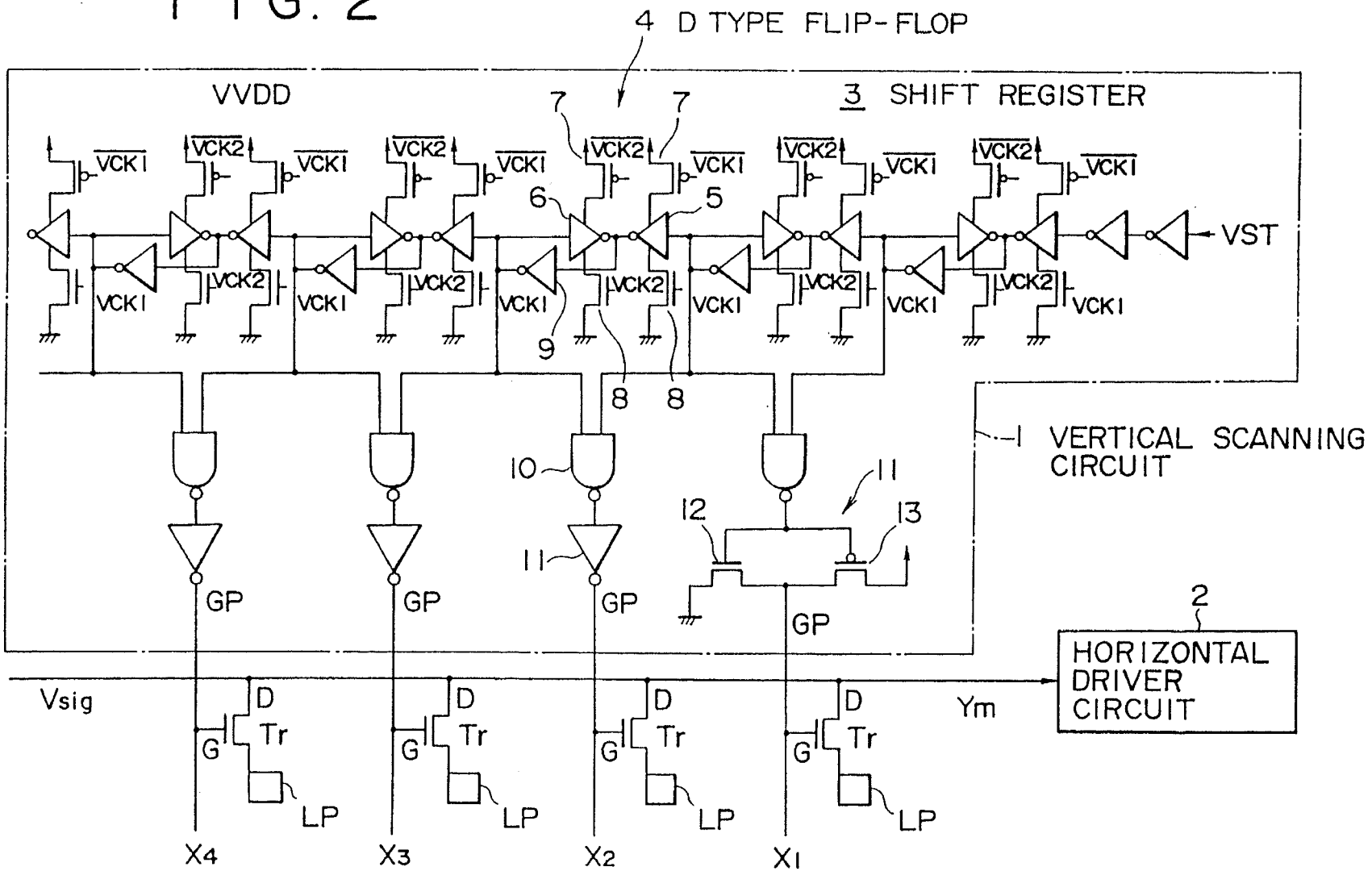
FIG. 2 is a circuit diagram showing a construction example for carrying out the driving method according to the present invention.

FIG. 2 is a construction example of a circuit for carrying out a first driving method according to the present invention. An active matrix liquid crystal display device has a display section comprising pixels LP composed of a liquid crystal arranged in a matrix, and transistors Tr for driving the pixels. In this figure, the pixels in one row are shown. A vertical scanning circuit 1 is connected to gate electrodes G of respective transistors Tr through gate lines X1, X2, X3, X4, . . . Gate pulses are applied in a linear sequence for performing the selection of the transistors Tr. A horizontal driver circuit 2 is connected to drain electrodes of respective transistors Tr through a signal line Ym for writing video signals Vsig in each pixel LP through the selected transistor Tr.

The vertical scanning circuit 1 is constituted of a shift resistor 3. The shift resistor 3 has a structure in which D type flip-flops 4 are connected to each other in multi-steps. Each of the D type flip-flops 4 is constituted of a pair of inverters 5 and 6 which have the common output terminal. Each inverter is connected to the side of a power supply VVDD through a p-type driver transistor 7, and is connected to the side of a ground through a n-type driver transistor 8. The paired driver transistors 7 and 8 become in the on-state in response to shift clock pulses Vck1 and Vck2 and the inversion pulses thereof for driving the inverters. The inverters 5 and 6 thus driven are called as the clock inverters. An input terminal of a third inverter 9 is connected to the output terminal to which the paired inverters 5 and 6 are commonly connected. The output pulse of the D type flip-flop in each step is transmitted to the output terminal of the third inverter 9. The output pulse is used as the input of the flip-flop in the next step. By inputting a starting signal VST to the D type flip-flop in the first step, the shift register 3 outputs an output pulse in which the phase is sequentially shifted by a half period for each step. The output pulse in the present step and the output pulse in the previous step are subjected to the logical operation by an AND gate device 10 and then inverted by the inverter 11, to thus obtain a gate pulse GP.

In this embodiment, the output inverter 11 has an asymmetric structure. Namely, in the output inverter 11, an n-type transistor 12 is set to be smaller than a p-type transistor 13 in the ratio W/L between the channel width W and the channel length L. In other words, the current capacity of the n-type transistor 12 is smaller than that of the p-type transistor 13. In a rise of the gate pulses GP from a low level to a high level, the p-type transistor 13 becomes in the on-state so that the rise of the gate pulses GP is shaped to be rapid. On the other hand, in a fall of the gate pulses GP, the n-type transistor 12 becomes in the on-state; however, since the current capacity thereof is smaller, the fall of the gate pulses is shaped to be smooth. Accordingly, the vertical scanning circuit 1 includes means for suppressing the voltage shift of the video signals Vsig written in the pixel LP by shaping the fall of the gate pulses GP smoothly.

Figure 3:
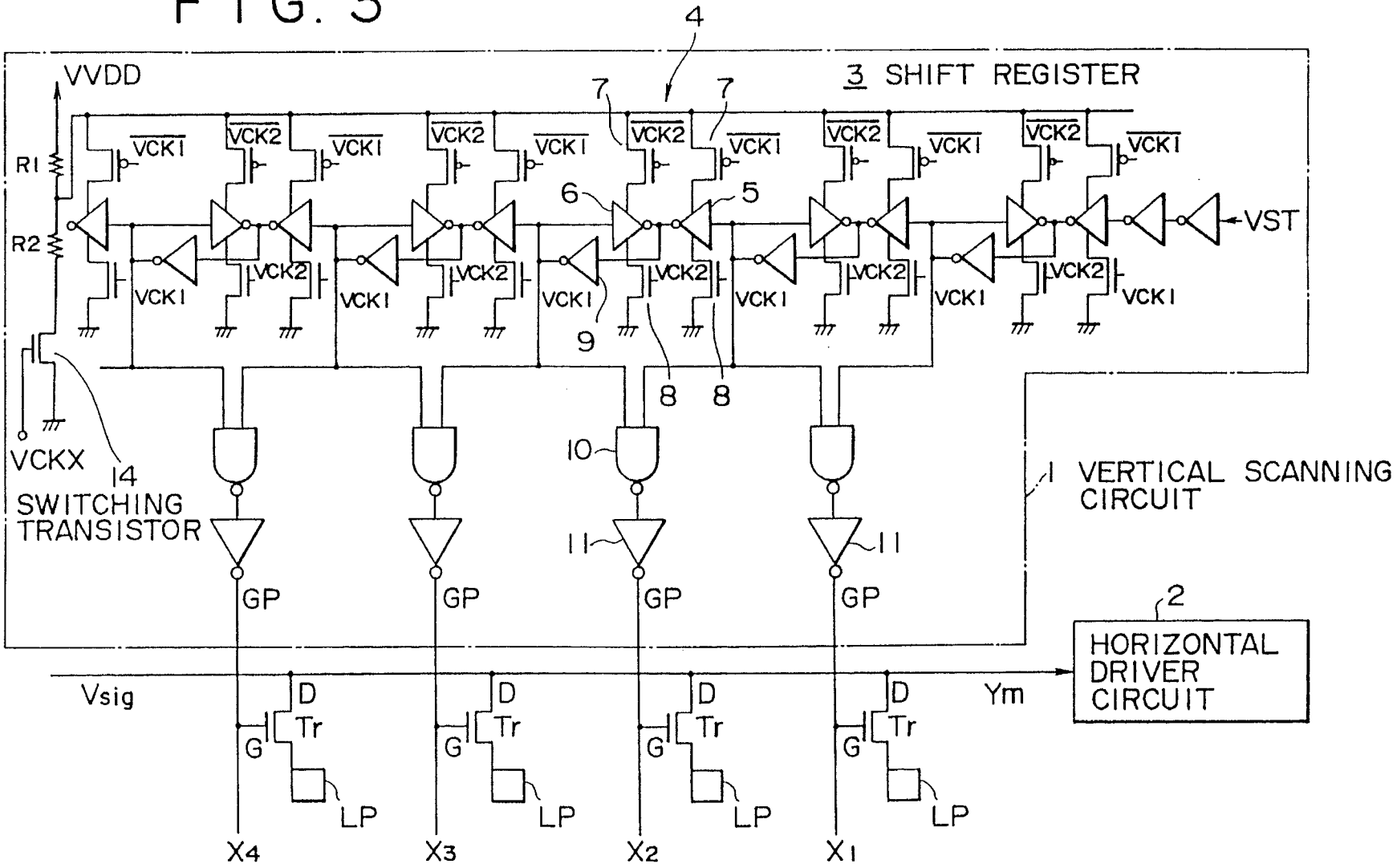
FIG. 3 is a circuit diagram showing another construction example for carrying out the driving method according to the present invention.

FIG. 3 is a circuit construction for carrying out a second driving method according to the present invention, which is similar to the above-described circuit construction as shown in FIG. 2. In addition, parts corresponding to those in FIG. 2 are indicated at the same reference numerals or characters. The difference lies in that a p-type driver transistor 7 of each D type flip-flop 4 is not directly connected to a power supply VVDD but connected to a central point between a pair of potential dividing resistances R1 and R2 connected in series to each other. In the potential dividing resistances R1 and R2, one end is connected to the power supply VVDD and the other end is connected to the side of the ground through a switching transistor 14. A gate electrode of the switching transistor 14 is periodically applied with a control voltage VCKX. When the switching transistor 14 is in the off-state, the supply voltage is supplied to a shift register 3 as it is, and the voltage level of each gate pulse GP is equal to the supply voltage. On the other hand, when the switching transistor 14 is in the on-state, the voltage divided with the ratio R1/R2 is supplied to the shift register 3, and thereby the voltage level of the gate pulse GP is reduced.

According to this embodiment, in the whole construction of a vertical scanning circuit 1, a portion of a gate driver comprising a shift register 3, AND gate circuits 10, and inverters 11 is formed within a substrate of the active matrix liquid crystal display device. On the other hand, the power supply circuit for supplying the supply voltage to the shift register 3, and a clock driver for supplying clock pulses Vck1 and Vck2 and the like are provided outside the substrate of the active matrix liquid crystal display device. In addition, the switching transistor 14 for switching the supply voltage and the potential dividing resistances R1 and R2 are formed within the substrate. However, the present invention is not limited to the above construction. The supply voltage from the power supply circuit connected to the outside may be periodically switched.

Figure 4:
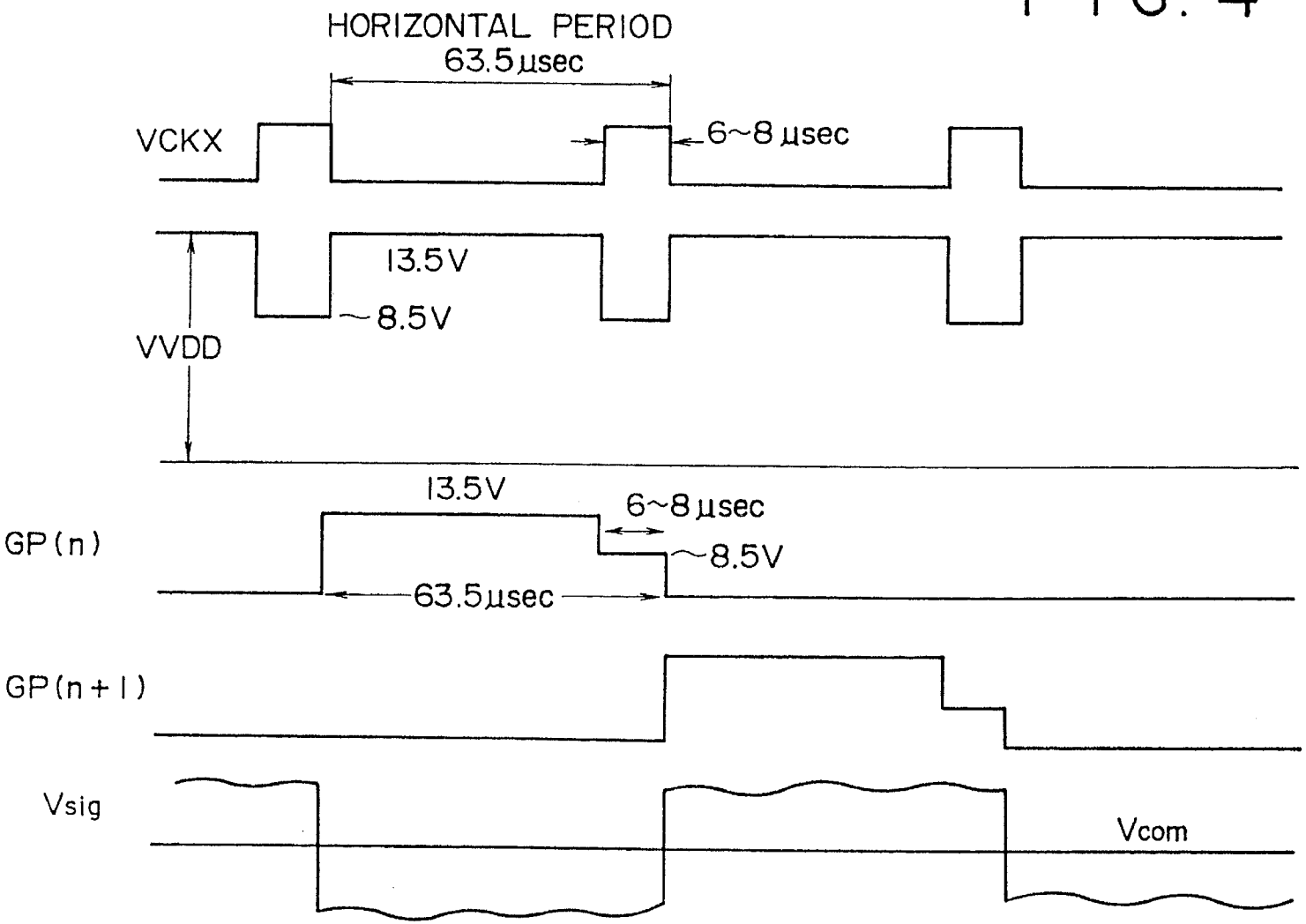
FIG. 4 is a timing chart for explaining the action of the circuit as shown in FIG. 3.

Next, the action of the circuit as shown in FIG. 4 will be described in detail with reference to FIG. 4. A control voltage VCKX applied to a gate electrode of a switching transistor 14 is changed in level so as to be pulsed in response to the horizontal synchronized signal. In this embodiment, the horizontal period is set at 63.5 μs, which is equivalent to the selected period of time for one gate line. The control voltage VCKX is changed to be in high level during the final portion of each horizontal period, that is, from 6 to 8 μs. This period of time is set not to exert an effect on the writting action of the video signals in the selected period of time. Namely, at the time when the video signals are written in a point sequence on the selected pixel of the gate line, the control voltage VCKX is selected to be in the high level. As the control voltage VCKX becomes the high level, the switching transistor 14 is in the on-state, so that the level of the supply voltage supplied to the shift register 3 is reduced, for example, from the VVDD set at 13.5 V to the about 8.5 V. The reduction amount is set by suitably determining the ratio of the paired potential dividing resistances R1 and R2.

According to a variation in the supply voltage, for example, the n-th gate pulse GP (n) is changed in level step-wisely from 13.5 V to 8.5 V within one horizontal period. The gate pulse GP (n+1) corresponding to the (n+1)-th gate line is generated within the next horizontal period, and which is changed in level step-wisely. During this period of time, in the video signals Vsig, the polarity is alternately inverted for the potential Vcom of the opposed electrode for each horizontal period. The so-called IH-inversion drive is carried out. By such an action, the vertical scanning circuit can suppress the voltage shift of the video signals Vsig written in each pixel by shaping a fall of the gate pulses GP through dropping the gate pulses after lowering the voltage level of the gate pulses GP once directly before stopping the applying of the gate pulses GP.

As described above, it is possible to suppress the voltage shift of the video signals by shaping a fall of the gate pulses smoothly or step-wisely. The shaping of the gate pulses can be achieved by contriving the construction of the vertical scanning circuit. In this case, the modification may be added to the circuit portion formed within the substrate of the active matrix liquid crystal display device, or the portion of the external circuit may be adjusted. However, in the case that the shaping of the gate pulses is carried out in the portion of the external circuit, the smooth shaping of a fall of the gate pulses is more simplified in terms of the circuit and is more preferable in the controllability as compared with the step-wise shaping thereof.

The present invention has the following effects: Namely, it is possible to suppress the voltage shift of the video signals by shaping of the gate pulses, and hence to reduce the rough-feeling on the video screen, resulting in the improvement of the display quality. Also, in the case of performing the shaping of the gate pulses in the external circuit, it is possible to eliminate the necessity of selecting the defective in the rough-feeling as the signal product of the active matrix liquid crystal display device, and hence to significantly improve the production yield. Further, since the voltage shift can be suppressed by the shaping of the gate pulses, it is possible to eliminating the necessity of making larger the auxiliary capacitor, which makes it possible to improve the display contrast without sacrificing the aperture ratio of each pixel.

What is claimed is:

1. An active matrix display device comprising:

a plurality of display elements arranged in a matrix, each of which display elements comprising a pixel which comprises opposed electrodes with electro-optical material therebetween, and a transistor for driving the pixel and having a gate electrode;

means for providing gate pulses sequentially to the gate electrode during a selected period of time to apply video signals to each pixel; and means for shaping the fall of the gate pulses into a step-wise shape.

2. An active matrix display device as claimed in claim 1, wherein said step-wise shape is formed by dropping the gate pulses after lowering a voltage level of the pulses just before a transition from the selected period to the non-selected period of time.

* * * * *